US005824163A

United States Patent [19]

Murphy

[11] Patent Number: 5,824,163

[45] Date of Patent: Oct. 20, 1998

[54] METAL CLEANING PROCESS THAT DOES NOT DAMAGE PLASTIC

[75] Inventor: Donald P. Murphy, Rochester Hills, Mich.

[73] Assignee: Henkel Corporation, Plymouth Meeting, Pa.

[21] Appl. No.: 808,549

[22] Filed: Feb. 28, 1997

[51] Int. Cl.[6] ..... C11D 3/06

[52] U.S. Cl. ..... 134/39; 134/40; 134/42

[58] Field of Search ..... 134/2, 3, 38, 39, 134/40, 41, 42

[56] References Cited

U.S. PATENT DOCUMENTS

| | | | |
|---|---|---|---|
| 3,717,590 | 2/1973 | Fetty . | |
| 3,725,224 | 4/1973 | Kendall . | |
| 3,879,216 | 4/1975 | Austin | 134/4 |
| 4,038,473 | 7/1977 | Cohen | 134/2 |
| 4,705,665 | 11/1987 | Malik | 422/12 |
| 4,873,174 | 10/1989 | Dhillon et al. . | |
| 5,077,008 | 12/1991 | Kralovic et al. | 422/37 |

*Primary Examiner*—Jeffrey Snay
*Attorney, Agent, or Firm*—Ernest G. Szoke; Wayne C. Jaeschke; Norvell E. Wisdom, Jr.

[57] ABSTRACT

An aqueous liquid composition containing dihydrogen phosphate salt, surfactant(s), and a dual coordinate bonding agent for iron cleans soiled metal surfaces without damaging any plastic parts that come into contact with the composition, supporting the growth of bacteria that cause unpleasant odors, or obscuring the transparency of any transparent window that it contacts. The composition is particularly useful for cleaning unpainted aluminum sided rail transport cars that have polycarbonate housings insulating electrical contact points that provide motive electric power to the cars; many conventional aqueous alkaline and acid cleaners promote stress cracking of polycarbonate plastics.

10 Claims, No Drawings

METAL CLEANING PROCESS THAT DOES NOT DAMAGE PLASTIC

BACKGROUND OF THE INVENTION

1. Field of the Invention

This invention relates to cleaning metal surfaces, both painted and unpainted, more particularly when the metal surfaces are adjacent to elements of plastic, especially polycarbonate plastic, which is susceptible to stress cracking when repeatedly contacted with many conventional metal cleaning compositions. This invention also relates to cleaning compositions that are useful in such cleaning processes, are not overly acidic or alkaline, and are not susceptible to developing undesirable odors from micro-organisms that readily come into contact with the compositions during normal storage or use.

2. Statement of Related Art

A very wide variety of cleaning compositions are known in the art. Few if any of these compositions, however, are known to be capable of fulfilling all the desiderata noted above, particularly for railroad cars that are powered by electricity. Such cars, like other railroad cars, come into contact with a wide variety of atmospheric pollutants and airborne soils that often lead to rapid deterioration in the aesthetic appearance of the exteriors of the cars. Ordinary rail cars that do not supply their own motive power can be readily cleaned by a variety of cleaners, usually most readily by fairly highly alkaline cleaners. However, rail cars that are directly powered by electricity, a type especially frequently used in mass transit operations, generally have housings of polycarbonate plastic on their exterior surfaces to protect electrical contacts that supply power to move the cars from a "third rail", overhead power line, or the like. This plastic readily develops stress cracks when contacted repeatedly by many alkaline solutions, including some of the most generally effective aqueous metal cleaning compositions. Such large vehicles can most conveniently be cleaned by sprayers, but it is a practical impossibility in many cases to protect any plastic parts of the exterior surface from contact with a sprayed cleaner composition, and frequent replacements of the plastic insulating housings are economically unacceptable.

DESCRIPTION OF THE INVENTION

1. Object of the Invention

Major objects of the present invention are to provide compositions and/or processes that (i) effectively clean painted and unpainted metal surfaces, (ii) do not damage any plastic materials, particularly polycarbonate plastic insulating housings, that are adjacent to the metal surfaces to be cleaned, (iii) are not susceptible to becoming malodorous as a result of infestation from commonly ambient micro-organisms, and (iv) do not have a pH lower than about 3 or higher than about 9, so as to minimize the likelihood of personal injuries to workers using the cleaners. A subsidiary object is to brighten unpainted aluminum surfaces, particularly those of Type 6061 T6 aluminum, that are cleaned using the compositions. Other objects will be apparent from the description below.

2. General Principles of Description

Except in the claims and the specific examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred, however. Also, unless expressly stated to the contrary: percent, "parts of", and ratio values are by weight; the term "polymer" includes "oligomer", "copolymer", "terpolymer", and the like; the first definition or description of the meaning of a word, phrase, acronym, abbreviation or the like applies to all subsequent uses of the same word, phrase, acronym, abbreviation or the like and applies, mutatis mutandis, to normal grammatical variations thereof; the description of a group or class of materials as suitable or preferred for a given purpose in connection with the invention implies that mixtures of any two or more of the members of the group or class are equally suitable or preferred; chemical descriptions of materials apply to the materials at the time of addition to any combination specified in the description or of generation within the composition by chemical reactions specified in the description between a newly added material and a distinct material already present, and do not necessarily preclude chemical changes to the materials as a result of reaction in the combination; in addition, specification of materials in ionic form means that the materials are supplied to prepare the compositions containing them in the form of soluble salts containing the ions specified and implies the presence in any composition specified to contain ionic materials of sufficient counterions to produce electrical neutrality for the composition as a whole; and any counterions thus implicitly specified preferably are selected from among other constituents explicitly specified in ionic form, to the extent possible; otherwise such counterions may be freely selected, except for avoiding counterions that act adversely to the objects of the invention.

SUMMARY OF THE INVENTION

Liquid cleaning compositions according to the invention have a pH value between 3 and 9 and comprise, preferably consist essentially of, or more preferably consist of, water and:

(A) dihydrogen phosphate ions and (B) a component of surfactant(s), preferably resistant to attack by micro-organisms; and, optionally, one or more of the following components:

(C) a component of dissolved molecules selected from the group consisting of organic molecules, each of which contains a total of at least two characteristic moieties selected from the group consisting of $—NR^1R^2$ moieties, where each of $R^1$ and $R^2$, which may be the same or different, is selected from the group consisting of hydrogen moieties and alkyl moieties having not more than three carbon atoms per alkyl moiety; $—OR^3$ moieties (which may or may not be part of carboxyl or phosphonyl moieties), where $R^3$ is selected from the group consisting of hydrogen moieties and alkyl moieties having not more than three carbon atoms per alkyl moiety; and $—SR^4$ moieties, where $R^4$ is selected from the group consisting of hydrogen moieties and alkyl moieties having not more than three carbon atoms per alkyl moiety; said at least two moieties being positioned within the molecule in such a way that two nitrogen, oxygen, or sulfur atoms in two of said moieties are separated from each other by at least two other atoms (and therefore can readily form sterically unstrained ring structures with at least five atoms per ring, by forming two coordinate bonds to an iron cation);

(D) a component of pH adjusting materials that are not part of any of the preceding components;

(E) a component of antifoam agent(s), other than those that are part of any of the preceding components; and (F) odorants and/or colorants, other than those that are part of any of the preceding components.

These compositions according to the invention may either be working compositions, suitable for direct use in cleaning, or concentrate compositions, suitable for dilution with additional water to produce a working composition.

A process according to the invention comprises at least a step of contacting a soiled metal surface with a liquid cleaning composition according to the invention as defined herein and maintaining sufficient relative motion between the liquid cleaning composition and the soiled metal surface to remove some of the soil from the surface by dissolving and/or dispersing the soil in the liquid cleaning composition.

DETAILED DESCRIPTION OF THE INVENTION, INCLUDING PREFERRED EMBODIMENTS

Compositions according to the invention preferably have no evidence of phase stratification visible to unaided normal human vision; i.e., the compositions may be cloudy or otherwise show evidence of suspended second phases, but preferably do not stratify into more than one liquid layer or contain any solid particles large enough to see individually with unaided normal human vision. If this conditions is not fulfilled, there is always some danger of concentration variations due to inhomogeneity of the composition.

The dihydrogen phosphate ions required for component (A) can be supplied by any soluble salt including such ions. For reasons of economy, ammonium, potassium, and sodium dihydrogen phosphates are preferred, with sodium most preferred. In a working cleaning composition according to the invention, the concentration of dihydrogen phosphate ions preferably is, with increasing preference in the order given, at least 0.50, 0.75, 1.0, 1.3, 1.6, 1.9, 2.2, 2.5, 2.8, 3.1, 3.4, 3.7, or 4.0 grams per liter (hereinafter usually abbreviated as "g/L"). For cleaning exceptionally heavily soiled surfaces, still higher concentrations, specifically at least, with increasing preference in the order given, 5, 7, 9, 11, 13, 15, or 17 g/L may be preferred. Primarily for reasons of economy, the concentration of dihydrogen phosphate ions in a working composition according to the invention independently preferably is, with increasing preference in the order given, not more than 100, 75, 50, 45, 40, 35, 30, 25, or 20 g/L and, unless the working composition is used on an exceptionally heavily soiled surface, more preferably is not more than 18, 16, 14, 12, 10, 8, 6, or 5.0 g/L.

There are two distinct preferred embodiments of the invention that affect the preference for component (B). If component (C) is not present, surfactant component (B) is preferably selected from anionic surfactant molecules including at least one aromatic ring and at least one sulfur atom per molecule. More preferably, this component is selected from surfactant molecules including two phenyl rings, which still more preferably are each bonded by a single bond to a single oxygen atom. Independently, in order to minimize the chance of development of malodorous growths of micro-organisms in the compositions according to the invention, the surfactant molecules preferably contain, with increasing preference in the order given, at least 2, 4, 6, 7, 8, 9, or 10 percent of sulfur, most preferably in the form of at least one sulfonate group bonded to each phenyl ring in the molecule. Also, independently, the surfactants are preferably ammonium, potassium, or sodium salts, most preferably sodium salts. Another independent preference is that the average molecular weight of the surfactant component preferably is, with increasing preference in the order given, at least 200, 300, 400, 450, 500, 525, 550, or 575 and independently preferably is, with increasing preference in the order given, not more than 1500, 1000, 900, 800, 750, 700, 675, 650, or 625. The single most preferred chemical type for surfactant component (B) for this first preferred specific embodiment of the invention is sodium salts of disulfonated tetrapropylene derivatives of 1,1 -oxy-bis-benzene, commercially available from Dow under the trade name DOWFAX™ 2A1.

The amount of surfactant component (B) in a working composition according to this first preferred embodiment of the invention preferably is at least, with increasing preference in the order given, 0.4, 0.8, 1.2, 1.6, 2.0, 2.2, 2.4, 2.6, 2.8, 3.0, or 3.2 g/L and independently preferably is, with increasing preference in the order given, not more than 15, 12, 10, 9.2, 8.2, 7.2, 6.2, 5.7, 5.3, 5.0, or 4.8 g/L. Independently, in either a concentrate or a working composition according to the invention, the ratio of the amount of surfactant component (B) to the amount of dihydrogen phosphate ions component (A) preferably is at least, with increasing preference in the order given, 0.05:1.0, 0.10:1.0, 0.13:1.0, 1.15:1.0, 0.16:1.0, 0.17:1.0, 0.18:1.0, 0.19:1.0, or 0.20:1.0 and independently preferably is not more than, with increasing preference in the order given, 0.50:1.0, 0.40:1.0, 0.35:1.0, 0.33:1.0, 0.31:1.0, 0.29:1.0, 0.27:1.0, 0.25:1.0, 0.24:1.0, 0.23:1.0, 0.22:1.0, or 0.21:1.0.

In a second preferred specific embodiment of the invention, when component (C) is present in a composition according to the invention, component (3) preferably includes at least a subcomponent (B.1) of anionic surfactant, which may constitute the entirety of component (B), although it preferably does not as noted below. The most preferred type of molecules for subcomponent (B.1) is partial esters, and salts of partial esters, of sulfuric and/or phosphoric acids with alcohols, preferably monoalcohols having at least, with increasing preference in the order given, 6, 8, 10, 12, or 14 carbon atoms per molecule and independently having not more than, with increasing preference in the order given, 24, 22, 20, or 18 carbon atoms per molecule. Independently, the alcohols esterified with sulfuric or phosphoric acids preferably are acyclic alcohols. Partial esters and salts of partial esters of phosphoric acid are more preferred than those of sulfuric acid.

Independently of its chemical constitution, subcomponent (B.1) for this second specific preferred embodiment preferably constitutes at least, with increasing preference in the order given, 25, 35, 45, 55, 60 or 65% of the total of component (B) and independently preferably constitutes not more than, with increasing preference in the order given, 95, 90, 85, 80, 75, or 70% of the total of component (B). Any balance of component (B) in excess of its content of subcomponent (B.1) is designated herein as subcomponent (B.2) and preferably is selected from nonionic surfactants. More preferably, subcomponent (B.2) comprises, still more preferably consists essentially of, or yet more preferably consists of sub-subcomponent (B.2.1) of acyclic nonionic surfactant and sub-subcomponent (B.2.2) of nonionic surfactants containing at least one substituted benzene ring in each molecule. When both subcomponents (B.2.1) and (B.2.2) are present in a composition according to the invention, the ratio of the amount of((B.2.1) to the amount of (B.2.2) preferably is at least, with increasing preference in the order given, 0.25: 1.0, 0.50: 1.0, 0.65:1.0, 0.75:1.0, 0.85:1.0, 0.95:1.0, 1.05:1.0, 1.15:1.0, 1.25:1.0, or 1.35:1.0 and independently preferably is not more than, with increasing preference in the order given, 5.0:1.0, 4.0:1.0, 3.5:1.0, 3.0:1.0, 2.5:1.0, 2.3:1.0, 2.1:1.0, 1.9:1.0, 1.7:1.0, 1.5:1.0, or 1.40:1.0.

In this second preferred embodiment, when component (C) is present, the ratio of the amount of component (B) to the amount of component (A) in a composition according to the invention preferably is at least, with increasing preference in the order given, 0.07:1.0, 0.15:1.0, 0.30:1.0, 0.35:1.0, 0.40:1.0, 0.45:1.0, 0.50:1.0, 0.52:1.0, 0.54:1.0, 0.56:1.0, or 0.58:1.0 and independently preferably is not more than, with increasing preference in the order given, 4.0:1.0, 3.0:1.0, 2.0:1.0, 1.5:1.0, 1.0:1.0, 0.80:1.0, 0.75:1.0, 0.70:1.0, 0.66:1.0, 0.64:1.0, 0.62:1.0, or 0.60:1.0.

The presence of optional component (C) in a composition according to the invention is preferred if the soil to be removed includes substantial amounts of iron metal or iron oxide(s). Such soil is normally present on the surface of rail cars to be cleaned according to the invention, because the operation of the cars produces iron dust from wear against the steel rails normally traversed by the cars, and this dust can readily become bound to the surface to be cleaned by other more adhesive components of the soil. It has been found that, when component (C) is not present in a composition according to the invention and rail cars with windows soiled with iron-oxide-containing soil are repeatedly cleaned with such a composition, visibility through the widows eventually becomes obscured by accumulation of an opaque material on the windows. Although the invention is not limited by any theory, it is believed that the opaque material building up on windows in such circumstance is one of the iron phosphates, many of which have quite small solubilities in water. This obscuration can be prevented by inclusion of an adequate amount of component (C) in a composition according to the invention.

More particularly, molecules that are part of component (C) are defined to have "dual coordinating effective moieties" (hereinafter usually abbreviated as "DCEM's") as follows: The total number of characteristic moieties for component (C) in each molecule is the number of DCEM's in the molecule unless the number of characteristic moieties is an odd number, in which instance the next lower even number of characteristic moieties is the number of DCEM's in the molecule. The total number of moles of DCEM's in component (C), when that component is present in a composition according to the invention, preferably has a ratio to the total number of moles of dihydrogen phosphate ions in the same composition that is at least, with increasing preference in the order given, 0.10:1.0, 0.20:1.0, 0.30:1.0, 0.40:1.0, 0.50:1.0, 0.55:1.0, 0.60:1.0, 0.65:1.0, 0.67:1.0, 0.69:1.0, 0.71:1.0, or 0.73:1.0 and independently preferably is not more than, with increasing preference in the order given, 5.0:1.0, 3.5:1.0, 3.0:1.0, 2.5:1.0, 2.0:1.0, 1.8:1.0, 1.6:1.0, 1.4:1.0, 1.30:1.0, 1.20:1.0, 1.10:1.0, 1.00:1.0, 0.90:1.0, 0.85:1.0, 0.83:1.0, 0.81:1.0, 0.79:1.0, or 0.77:1.0.

Independently, each of $R^1$–$R^4$ in the general formulas for the moieties included in molecules of component (C) preferably is, with increasing preference in the order given, a 1-propyl, an ethyl, a methyl, or a hydrogen moiety. For reasons of economy and avoidance of possible odor nuisances, moieties containing oxygen are normally preferred over those containing either nitrogen or sulfur for component (C) of a composition according to this invention.

If, as is often true, discharge of waste water containing substantial amounts of iron is limited by anti-pollution laws, the single most preferred constituent for component (C) is citric acid. The reason for this preference is that iron can be readily precipitated, from solutions in which it is coordinately bonded to citric acid, by raising the pH to a sufficient level to cause the iron to precipitate as hydrated iron oxide(s), and the remaining waste water can then usually be lawfully discharged to the environment. If stronger bond-forming materials such as EDTA are used for component (C), this method of removing the iron from waste cleaning water generated by practical use of a process according to this invention is at best more difficult and may be practically impossible.

Independently of other preferences, a working composition according to the invention that does not contain component (C) preferably has a pH value that is at least, with increasing preference in the order given, 3.1, 3.3, 3.5, 3.6, 3.7, 3.8, 3.9, or 4.0 and independently preferably is, with increasing preference in the order given, not more than 8, 7, 6.5, 6.0, 5.8, 5.6, 5.4, 5.3, 5.2, 5.1, or 5.0. A working composition according to the invention that does contain component (C) preferably has a pH value that is at least, with increasing preference in the order given, 3.10, 3.20, 3.30, 3.40, or 3.50 and independently preferably is, with increasing preference in the order given, not more than 8, 7, 6.5, 6.0, 5.8, 5.6, 5.4, 5.2, 5.0, 4.8, 4.6, 4.4, 4.2, 4.0, 3.8, 3.70, or 3.60.

The presence of an acid with a higher ionization constant than dihydrogen phosphate ions as part of optional component (D) in a composition according to the invention that does not contain component (C) is normally preferred, especially when the metal surface to be cleaned is unpainted and a brightening effect on the cleaned surface is desired. Within the broadest scope of the invention, any acidic material that is a stronger acid than dihydrogen phosphate ions may be used for this purpose. However, organic acids are generally less preferred, because they have been observed to be more likely to cause stress cracking of polycarbonate plastics than inorganic acids. The single most preferred material for component (D) when component (C) is not present is orthophosphoric acid. For any particular chemical substance in component (D), the "effective number of acid hydrogen atoms per molecule" is hereby defined as the number of hydrogen atoms per molecule of the substance that are formed by ionization, in a composition according to the invention, by a reaction with a higher ion product constant than that, in the same composition according to the invention, for the reaction: $H_2PO_4^- \leftrightharpoons HPO_4^{-2} + H^+$. Also, the "effective moles of acid" (hereinafter usually abbreviated "EMA") for any particular amount of a component (D) according to this invention with a particular composition consisting of n distinct chemical substances, where n represents a positive integer, each of said distinct chemical substances having an effective number of acid hydrogen atoms per molecule of $e_p$, where i represents an integer from 1 to n that denotes the i'th substance in the number of distinct chemical substances, each of said distinct chemical substances being present in a number of moles $m_i$, is defined for later use herein by equation (1) below:

$$EMA = \sum_{i=1}^{n} m_i \cdot e_i. \tag{1}$$

Independently of the chemical nature of the acid, the amount of component (D) in a composition according to the invention that does not contain component (C) preferably is such that the ratio of the EMA of component (D) to the number of moles of dihydrogen phosphate ions in component (A) present along with component (D) in a composition according to the invention preferably is at least, with increasing preference in the order given, 0.005:1.0, 0.015:1.0, 0.025:1.0, 0.035:1.0, 0.045:1.0, 0.050:1.0, 0.055:1.0, 0.057:1.0, 0.059:1.0, 0.061:1.0, 0.063:1.0, or 0.065:1.0 and independently preferably is not more than, with increasing preference in the order given, 0.40:1.0, 0.30:1.0, 0.20: 1.0, 0.15:1.0, 0.10:1.0, 0.090:1.0, 0.085:1.0, 0.080:1.0, 0.075:1.0, 0.070:1.0, or 0.067:1.0.

If component (C) is present and is acidic, there is ordinarily no need for any other stronger acid than dihydrogen phosphate in a composition according to the invention in order to obtain a brightening effect, and indeed as already noted the most preferred pH values are slightly more alkaline for any composition according to the invention that contains component (C). Accordingly, the pH value in such instances is preferably adjusted primarily with the most economical source of alkalinity or alkalinity as needed, usually sodium hydroxide or phosphoric acid. In addition, boric acid has been found to be a desirable constituent of compositions according to the invention, at least if the compositions include component (C). Because boric acid has a buffering action, it is considered part of component (D) when present, but its presence is preferred even if no pH adjustment is otherwise needed. The amount of boric acid present is preferably such as to have a ratio to the amount of dihydrogen phosphate ions in the same composition that is at least, with increasing preference in the order given, 0.030:1.0, 0.070:1.0, 0.11:1.0, 0.15:1.0, 0.17:1.0, 0.19:1.0, 0.21:1.0, or 0.23:1.0 and independently preferably is not more than, with increasing preference in the order given, 2.0:1.0, 1.6:1.0, 1.2:1.0, 0.80:1.0, 0.60:1.0, 0.40:1.0, 0.35:1.0, 0.32:1.0, 0.29:1.0, or 0.27:1.0.

Ordinarily, antifoam component (E) is not needed in a composition according to this invention, because most such compositions with preferred ingredients in preferred amounts have not been observed to be prone to excessive foaming. If antifoaming agent should be needed, the most effective ones tested have been found to be PARCOLENE® 95B concentrate, P3® Defoamer 2483, and PARCO® Defoamer 14, all available commercially from the Parker Amchem Div. of Henkel Corp., Madison Heights, Mich., USA and FOAM BAN™ MS-30, commercially available from Ultra Additives, Inc., Paterson, N.J.

Component (F) is not normally required for any technical reason, but may be aesthetically advantageous for certain uses of compositions according to the invention.

For various reasons, it is often preferred that many ingredients used in other cleaning compositions should not be present in compositions according to the invention. Specifically, it is increasingly preferred in the order given, independently for each preferably minimized type of material listed below, that compositions according to the invention contain no more than 10, 5, 3, 2.0, 1.0, 0.60, 0.35, 0.10, 0.08, 0.04, 0.02, 0.01, 0.005, 0.002, or 0.001 percent of each of the following materials: alkali metal, alkaline earth metal, and ammonium hydroxides, monohydrogen phosphates, phosphates, condensed phosphates, and sulfates, the preference for minimization of these components applying only to compositions according to the invention that do not contain component (C); any chemical form of any metals other than alkali and alkaline earth metals; nitrates and other oxidizing agents (the others being measured as their oxidizing stoichiometric equivalent as nitrate) that are not part of one of the necessary or optional components of compositions according to the invention as described above; alcohols, ethers, ether alcohols, hydrocarbons, halocarbons, halohydrocarbons, aldehydes, or ketones that are not part of one of the necessary or optional components of compositions according to the invention as described above; and silicates and oxides of silicon.

A process according to the invention normally, primarily for convenience, is preferably performed at whatever ambient temperature is naturally prevailing, provided that this temperature is not too low for the cleaning composition used to remain liquid. Preferably, the cleaning composition is used at a temperature of at least, with increasing preference in the order given, 10°, 15°, 20°, 25°, or 30° C. Cleaning effectiveness generally increases with increasing temperature of use, up to at least 50° C. Preferably, the use temperature is not more than 55° C.

A concentrate composition according to the invention contains at least components (A) and (B) as described above and preferably also contains component (D) when the latter is desired in the working composition(s) to be made from the concentrate. More preferably, a concentrate composition according to the invention contains all of the components of a working composition according to the invention that are identified by letter above and are desired in the working composition(s) to be made from the concentrate composition. Independently of all other preferences with respect to concentrates, the concentration in a concentrate of any component of compositions according to the invention that is identified by letter above preferably is not less than, with increasing preference in the order given, 2, 3, 4, 5, 6, 7, 8, 9, or 10 times larger than any preferred concentration specified above for the same component in working compositions and independently preferably is, with increasing preference in the order given, not more than 50, 40, 35, 30, 25, 20, 17, 15, 13, or 11 times larger than any preferred concentration specified above for the same component in working compositions.

The invention is explained in greater detail below using working examples, and the benefits of the invention are illustrated by comparative examples.

Examples and Comparison Examples Group 1

Four possible cleaner compositions, as shown in Table 1.1 below, were made in concentrate form. A 5% by volume solution in water of each of Concentrates 1.2–1.4 and of sodium hydroxide were made to test for evidence of damage to polycarbonate plastic. Large electrical connectors with insulating blue polycarbonate plastic housings as actually used by the Bay Area Rapid Transit System in Northern California were tested by soaking in these potential working compositions, maintained at normal ambient temperatures from 20°–25° C., for the times and with the results shown in Table 1.2 below. Concentrates 1.1, 1.3, and 1.4 are according to the invention and Concentrate 1.2 is not, because it lacks dihydrogen phosphate ions. Concentrate 1.1 is less preferred because of its spontaneous phase stratification.

TABLE 1.1

CONCENTRATES FOR GROUP 1

| Ingredient | % of Ingredient in Concentrate Number: 1.1 | 1.2 | 1.3 | 1.4 |
|---|---|---|---|---|
| Water | 47 | 34 | 77.4 | 77 |
| Sodium Dihydrogen Phosphate | 47 | 0 | 16 | 17 |
| Gluconic Acid | 0 | 60 | 0 | 0 |
| DOWFAX ™ 2A1 Surfactant* | 6 | 6 | 6 | 6 |
| Pine Oil (odorant) | 0 | 0 | 0.6 | 0 |
| Visible Phase Stratification? | Yes | No | No | No |

Footnote for Table 1.1

*This material is reported by its supplier to be an aqueous solution containing about 47% of its surfactant ingredients, which are benzene, 1,1-oxybis, tetrapropylene derivative, disulfonated, sodium salts.

TABLE 1.2

EFFECT OF WORKING COMPOSITIONS ON POLYCARBONATE

| Test Working Composition Made From: | Effect on Polycarbonate after Exposure for: 94 Hours | 142 hours |
|---|---|---|
| Sodium Hydroxide | Severely cracked | Not further tested |
| Concentrate 1.2 | Slightly cracked | Not further tested |

TABLE 1.2-continued

| EFFECT OF WORKING COMPOSITIONS ON POLYCARBONATE | | |
|---|---|---|
| Test Working Composition Made From: | Effect on Polycarbonate after Exposure for: 94 Hours | 142 hours |
| Concentrate 1.3 | No cracking visible | No cracking visible |
| Concentrate 1.4 | No cracking visible | No cracking visible |

Group 2—Foam Testing of Compositions Containing Antifoam Agents

A concentrate composition according to the invention prepared for the purposes of these tests had the ingredients and concentrations specified in Table 2.1 below.

TABLE 2.1

| CONCENTRATE COMPOSITION FOR GROUP 2 | |
|---|---|
| Ingredient | Grams of Ingredient per Kilogram of Concentrate Composition |
| Tap Water | 756 |
| Anhydrous Sodium Dihydrogen Phosphate | 170 |
| 75% Aqueous Orthophosphoric Acid | 14 |
| DOWFAX ™ 2A1 Surfactant | 60 |

Ordinarily, this concentrate would be used at 5–20% by volume to make working cleaning compositions according to the invention. However, for purposes of this testing, 1% by volume solutions were used instead, to exaggerate the foaming tendency, which is stronger in more dilute solutions.

The general procedure for antifoam testing was as follows: A volume of 3 milliliters (hereinafter usually abbreviated "mL") of the concentrate was diluted to 300 mL with cold tap water and shaken in a stoppered mixing cylinder with 500 mL capacity to generate foam. Five (5) drops of the antifoam agent being tested were then added, and the mixture shaken again. If adequate defoaming was achieved by this addition of 5 drops of antifoam agent, enough additional antifoam agent to produce a total concentration of 1% by volume of the antifoam agent in the mixture was then added to the mixture to check for any phase stratification or other evidence of inhomogeneity. If 5 drops of defoamer were not sufficient, additional drops were added until adequate defoaming had been achieved, or until the amount of antifoam agent reached 0.25%. If adequate defoaming had been achieved with less than 0.25 % by volume of antifoam agent in the total mixture, enough antifoam agent to bring its concentration to 1% was then added to check for any phase stratification or other evidence of inhomogeneity.

The antifoam agents tested are shown in Table 2.2, and the foam testing results, keyed to the identifying numbers given in Table 2.2, are described below after the Table.

TABLE 2.2

| ANTIFOAM AGENTS TESTED | | |
|---|---|---|
| Trade Name of Antifoam Agent | Supplier of Antifoam Agent | No. |
| PARCO ® Defoamer 14 | Parker Amchem Div. of Henkel Corp. | 1 |
| P3 ® Defoamer 2483 | Parker Amchem Div. of Henkel Corp. | 2 |

TABLE 2.2-continued

| ANTIFOAM AGENTS TESTED | | |
|---|---|---|
| Trade Name of Antifoam Agent | Supplier of Antifoam Agent | No. |
| 10% Aqueous Solution of FOAM BAN ™ MS-575 | Ultra Additives, Inc., Paterson, NJ | 3 |
| PARCOLENE ® 95B | Parker Amchem Div. of Henkel Corp. | 4 |
| ANTAROX ™ M LF-222 | Rhone-Poulenc | 5 |
| PLURONIC ™ L-61 | Rhone-Poulenc | 6 |
| BEVELOID ™ 6244 | Rhone-Poulenc | 7 |
| FOAM BAN ™ MS-30 | Ultra Additives, Inc., Paterson, NJ | 8 |

Test Results:

1. Good defoaming with 5 drops. Raising antifoam agent to 1% produced scum floating on the surface and made the bulk of the liquid opaque.
2. Good defoaming with 5 drops, better than with antifoam agent 1. Raising antifoam agent to 1 % produced white solid scum floating on the surface and made the bulk of the liquid translucent.
3. Good defoaming requires 8 drops. Raising antifoam agent to 1% did not produce any visible phase stratification, and the liquid remained clear.
4. Very good defoaming action with 5 drops, even better than antifoam agent 2. Raising antifoam agent to 1% produced slight oily spot floating on the surface and made the bulk of the liquid substantially opaque.
5. Little or no defoaming effect even at 0.25%.
6. Little or no defoaming effect even at 0.25%.
7. Good defoaming required 8 drops. Raising antifoam agent to 1% produced a slight scum floating on the surface.
8. Very good defoaming with 5 drops. Raising antifoam agent to 1% made the bulk of the liquid translucent, but there was no evidence of phase stratification.

Group 3—Compositions with Dual Coordinate Bonding Component Present

A preferred concentrate of this type has the ingredients shown in Table 3, in addition to water, which constitutes the balance of the composition.

TABLE 3

| CONCENTRATE COMPOSITION FOR GROUP 3 | |
|---|---|
| Ingredient | Grams of Ingredient per Kilogram of Concentrate Composition |
| Anhydrous Sodium Dihydrogen Phosphate | 100 |
| TRITON ™ H-66 Surfactant Sotution | 63 |
| ANTAROX ™ LF-330 Surfactant | 10.0 |
| ANTAROX ™ LF-222 Surfactant | 7.0 |
| Citric Acid | 30 |
| Boric Acid, Technical granular | 20 |
| 50% Sodium Hydroxide in Water Solution | 5.0 |

TRITON™ H-66 surfactant solution was obtained commercially from Union Carbide Corp. and is reported by its supplier to be a 50% solution in water of active surfactant molecules that are potassium salts of partial esters of phosphoric acid with alcohols. ANTAROX™ LF-330 and ANTAROX™ LF-222 surfactants were both obtained commercially from Rhône-Poulenc and are reported by their supplier to consist of 95% of "modified linear aliphatic polyethers" and 100% of "modified aromatic polyethers" respectively.

Solutions in water of from 3 to 20 or more volume percent of this concentrate are excellent working compositions according to the invention for cleaning rail cars, without damaging any plastic parts on the cars and/or clouding the windows of the cars, even when the latter are soiled with iron and/or iron oxide dust before cleaning.

The invention claimed is:

1. A process of cleaning a soiled metal surface, which may or may not be covered with a protective organic coating and which is in a fixed spatial position with respect to at least one plastic surface, by contacting the soiled metal surface with an aqueous liquid cleaning composition and maintaining relative motion between the liquid cleaning composition and the soiled metal surface to remove at least some of the soil from the metal surface by dissolving and/or dispersing the soil in the liquid cleaning composition, the contacting of the soiled metal surface being by a method that also results in contacting at least part of the plastic surface with respect to which the soiled metal surface is in a fixed spatial position, wherein the improvement comprises utilizing as the aqueous liquid cleaning composition a composition that has a pH value in the range from about 3 to about 9 and comprises water and:

(A) dihydrogen phosphate ions; and (B) a surfactant component of molecules selected from the group consisting of molecules that are resistant to attack by micro-organisms.

2. A process according to claim 1, wherein the aqueous cleaning composition consists essentially of water and:

(A) a concentration from about 0.5 to about 25 g/L of dihydrogen phosphate ions;

(B) a concentration of component (B), said component (B) including a concentration of anionic surfactant, such that (i) the concentration of component (B) has a ratio to the concentration of component (A) that is from about 0.07:1.0 to about 4.0:1.0 and (ii) the concentration of anionic surfactant is at least about 25% of the concentration of total component (B); and (C) a concentration of a component of dissolved molecules selected from the group consisting of organic molecules, each of which contain a total of at least two moieties selected from the group consisting of —$NR^1R^2$ moieties, where each of $R^1$ and $R^2$, which may be the same or different, is selected from the group consisting of hydrogen moieties and alkyl moieties having not more than three carbon atoms per alkyl moiety; —$OR^3$ moieties (which may or may not be part of carboxyl or phosphonyl moieties), where $R^3$ is selected from the group consisting of hydrogen moieties and alkyl moieties having not more than three carbon atoms per alkyl moiety; and —$SR^4$ moieties, where $R^4$ is selected from the group consisting of hydrogen moieties and alkyl moieties having not more than three carbon atoms per alkyl moiety; said at least two moieties being positioned within the molecule in such a way that two nitrogen, oxygen, or sulfur atoms in two of said moieties are separated from each other by at least two other atoms; and, optionally, one or more of:

(D) a concentration of a pH adjusting component selected from molecules that are not part of any of the preceding components;

(E) a concentration of a component of antifoam agent(s), other than those that are part of any of the preceding components;

(F) odorants, colorants, or both odorants and colorants, other than those that are part of any of the preceding components.

3. A process according to claim 2, wherein, in the aqueous liquid cleaning composition: (i) the concentration of component (A) is from about 1.0 to about 20 g/L, (ii) the ratio of the concentration of component (B) to the concentration of component (A) is from about 0.15:1.0 to about 1.5:1.0; (iii) the concentration of anionic surfactant is from about 35% to about 90% of the concentration of total component (B); (iv) non-ionic surfactant molecules constitute all of component (B) that is not anionic surfactant molecules; (v) the concentration of component (C) provides a molar concentration of dual coordinate bonding effective moieties ("DCEM's") that has a ratio to the molar concentration of component (A) that is from about 0.20:1.0 to about 3.0:1.0; and (vi) there is a pH value not greater than about 6.0.

4. A process according to claim 3, wherein, in the aqueous cleaning composition: (i) the concentration of component (A) is from about 1.6 to about 16 g/L, (ii) the ratio of the concentration of component (B) to the concentration of component (A) is from about 0.30:1.0 to about 1.0:1.0; (iii) the concentration of anionic surfactant is from about 45% to about 90% of the concentration of total component (B); (v) the molar concentration of DCEM's has a ratio to the molar concentration of component (A) that is from about 0.30:1.0 to about 2.0:1.0; and (vi) there is a pH value not greater than about 5.6.

5. A process according to claim 4, wherein, in the aqueous cleaning composition: (i) the concentration of component (A) is from about 2.2 to about 14 g/L, (ii) the ratio of the concentration of component (B) to the concentration of component (A) is from about 0.35:1.0 to about 0.80:1.0; (iii) the concentration of anionic surfactant is from about 55% to about 85% of the concentration of total component (B); (v) the molar concentration of DCEM's has a ratio to the molar concentration of component (A) that is from about 0.40:1.0 to about 1.6:1.0; and (vi) there is a pH value not greater than about 5.4.

6. A process according to claim 5, wherein, in the aqueous cleaning composition: (1) the anionic surfactant molecules of component (B) are selected from the group consisting of partial esters, and salts of partial esters, of sulfuric acid and phosphoric acid with alcohols; (2) component (C) consists of molecules selected from the group consisting of organic molecules, each of which contain a total of at least two —OH moieties; and (3) boric acid is present in a concentration such that the concentration of boric acid has a ratio to the concentration of dihydrogen phosphate ions that is from about 0.070:1.0 to about 0.60:1.0.

7. A process according to claim 6, wherein, in the aqueous cleaning composition: (i) the concentration of component (A) is from about 2.8 to about 10 g/L, (ii) the ratio of the concentration of component (B) to the concentration of component (A) is from about 0.45:1.0 to about 0.75:1.0; (iii) the concentration of anionic surfactant is from about 60% to about 80% of the concentration of total component (B); (v) the molar concentration of —OH moieties has a ratio to the molar concentration of component (A) that is from about 0.50:1.0 to about 1.30:1.0; and (vi) there is a pH value not greater than about 4.6.

8. A process according to claim 7, wherein, in the aqueous cleaning composition: (1) the anionic surfactant molecules of component (B) are selected from the group consisting of partial esters, and salts of partial esters, of phosphoric acid with acyclic monoalcohols having from 10 to 20 carbon atoms per molecule; (2) component (C) consists of molecules selected from the group consisting of organic molecules, each of which contain a total of at least two —OH moieties and no nitrogen or sulfur atoms; and (3)

boric acid is present in a concentration such that the concentration of boric acid has a ratio to the concentration of dihydrogen phosphate ions that is from about 0.11:1.0 to about 0.35:1.0.

9. A process according to claim 8, wherein, in the aqueous cleaning composition: (i) the concentration of component (A) is from about 2.8 to about 8 g/L, (ii) the ratio of the concentration of component (B) to the concentration of component (A) is from about 0.50:1.0 to about 0.70:1.0; (v) the molar concentration of —OH moieties has a ratio to the molar concentration of component (A) that is from about 0.67:1.0 to about 1.00:1.0; and (vi) there is a pH value not greater than about 4.6.

10. A process according to claim 9, wherein, in the aqueous liquid cleaning composition: (i) the concentration of component (A) is from about 4.0 to about 5.0 g/L, (ii) the ratio of the concentration of component (13) to the concentration of component (A) is from about 0.56:1.0 to about 0.62: 1.0; (iii) the concentration of anionic surfactant is from about 60% to about 75% of the concentration of total component (1); (iv) both acyclic nonionic surfactant molecules and substituted benzene ring-containing nonionic surfactant molecules are present in a ratio of acyclic to substituted-benzene-ring-containing molecules that is from about 1.25:1.0 to about 1.50:1.0; (v) there is a concentration of citric acid that provides a molar concentration of OH moieties that has a ratio to the molar concentration of component (A) that is from about 0.71:1.0 to about 0.79:1.0; (vi) there is a pH value from about 3.0 to about 4.0; and (vii) boric acid is present in a concentration such that the concentration of boric acid has a ratio to the concentration of dihydrogen phosphate ions that is from about 0.21:1.0 to about 0.29:1.0.

* * * * *